United States Patent [19]

Keyasko

[11] Patent Number: 4,543,803

[45] Date of Patent: Oct. 1, 1985

[54] LIGHTWEIGHT, RIGID, METAL PRODUCT AND PROCESS FOR PRODUCING SAME

[76] Inventor: Mark Keyasko, 228 Hilton Ave., Maplewood, N.J. 07040

[21] Appl. No.: 556,301

[22] Filed: Nov. 30, 1983

[51] Int. Cl.[4] ..... A44C 25/00; B44C 1/04

[52] U.S. Cl. ..... 63/2; 29/10; 29/160.6; 59/80; 59/82; 63/3; 63/12; 63/26; 204/16; 204/18.1; 204/24

[58] Field of Search ..... 204/8, 11, 16, 18.1, 204/24–26; 29/160.6, 10; 63/2, 3, 4, 12, 26, 27, 28; 59/80, 82

[56] References Cited

U.S. PATENT DOCUMENTS

| | | | |
|---|---|---|---|
| 1,600,722 | 9/1926 | Edison | 204/16 |
| 1,934,643 | 11/1933 | Rafton | 29/160 |
| 2,640,789 | 6/1953 | Hausner | 204/24 |
| 2,978,389 | 4/1961 | Turnbull | 204/24 |
| 3,453,185 | 7/1969 | Nakagawa | 204/24 |
| 3,482,300 | 12/1969 | Reinke | 29/160 |
| 3,540,988 | 11/1970 | Wells et al. | 204/24 |
| 3,862,018 | 1/1975 | Mentone | 204/32 |
| 3,886,051 | 5/1975 | Albright et al. | 204/18.1 |
| 4,079,552 | 3/1978 | Fletcher | 204/16 |
| 4,155,721 | 5/1979 | Fletcher | 204/16 |
| 4,348,861 | 9/1982 | Nakagama | 204/28 |
| 4,369,098 | 1/1983 | Van Rueyen | 204/16 |

FOREIGN PATENT DOCUMENTS

| | | | |
|---|---|---|---|
| 1257796 | 12/1971 | United Kingdom | 204/24 |

*Primary Examiner*—Andrew H. Metz
*Assistant Examiner*—Terryence Chapman
*Attorney, Agent, or Firm*—Lerner, David, Littenberg, Krumholz & Mentlik

[57] ABSTRACT

A lightweight, rigid, metal product and a process for preparing such a product are disclosed in which a wire metal mesh is formed into a desired three-dimensional shape and is then electroplated to plate a metal thereon to fill the voids of mesh and provide the rigid product in such desired shape. Stone-settings employing the product and process are also disclosed.

28 Claims, 7 Drawing Figures

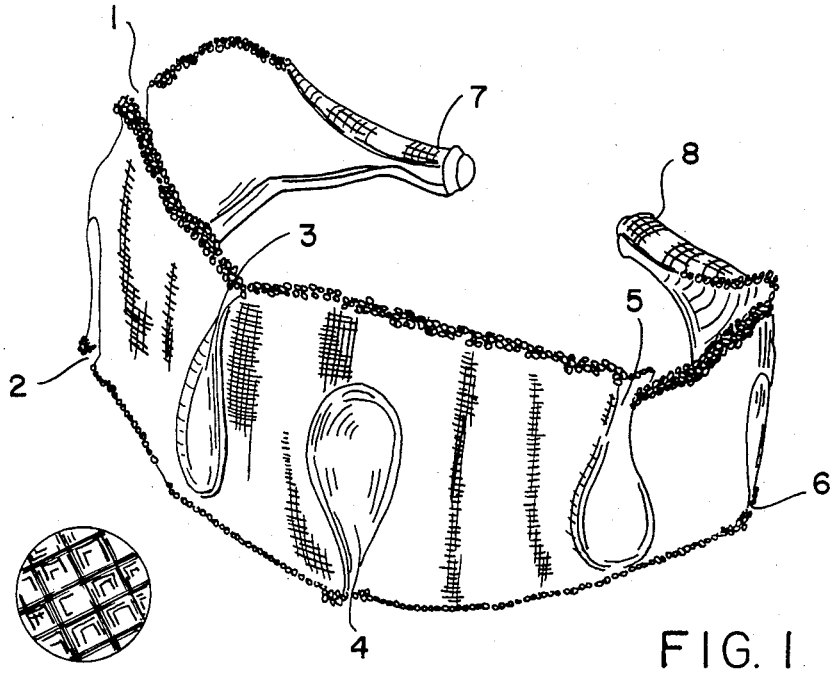
FIG. 1
FIG. 1a
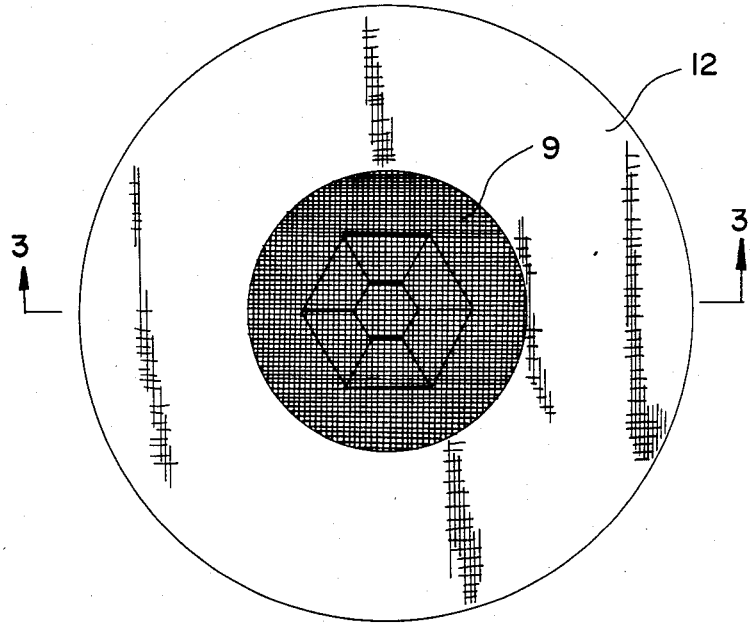
FIG. 2

LIGHTWEIGHT, RIGID, METAL PRODUCT AND PROCESS FOR PRODUCING SAME

BACKGROUND OF THE INVENTION

The present invention relates to a lightweight, rigid, metal product having a wire metal mesh substrate with a metal electroplated thereon so as to at least fill the voids of the wire metal mesh and to processes for preparing such products. More particularly, the present invention relates to ornamental metal products, e.g., sculpture or jewelry such as earrings, bracelets, necklaces, pendants, and rings, and to processes for preparing such ornamental products.

A number of patents disclose the electroplating of wire metal meshes so as to provide "rigidized" wire screening, e.g., for use in a silkscreening process. In this connection, reference is made to Reinke U.S. Pat. No. 3,482,300; Menton U.S. Pat. No. 3,862,018; and Wells et al. U.S. Pat. No. 3,540,988.

SUMMARY OF THE INVENTION

It has now been found that a lightweight, rigid, metal product, especially useful a an ornamental product such as jewelry or sculpture, can be provided by an electrically conductive wire metal mesh in a desired three-dimensional shape, wherein the wire metal mesh has a plurality of woven wire strands defining voids therebetween and has a metal electroplated on the surfaces thereof so as at least to fill the voids of the mesh and provide a rigid structure for the product in the desired three-dimensional shape. As mentioned above, these metal products are preferably ornamental products such as a sculpture or a piece of jewelry such as an earring, bracelet, necklace, pendant, or ring.

The present invention also contemplates a process for preparing such metal products in which an electrically conductive wire metal mesh having a plurality of woven wires strands defining voids therebetween is formed into a desired three-dimensional shape. A metal is electroplated onto this shaped wire metal mesh so as at least to fill the voids of the mesh and to provide a metal product in said desired three-dimensional shape. Again, in a preferred embodiment of this process, the wire metal mesh is formed into a three-dimensional ornamental shape such as a sculptural shape or a piece of jewelry such as an earring, bracelet, necklace, pendant, or ring, which overall shape is maintained in the final electroplated product.

The product and process of the invention provide a number of distinct advantages, especially in providing ornamental products such as jewelry pieces. The product and process of the invention allow the production of a large sculptured piece such as a large sculptured earring which is light in weight yet is sufficiently rigid and strong to withstand normal handling and even greater forces. I believe that these effects can be considered synergistic because the final product provides greater strength than could be expected from a similar metal product formed of the same material as the electroplating metal or from the wire metal mesh. With the process and product of the invention, there is a physical intermeshing of the electroplating metal with the wire metal mesh substrate, i.e., the electroplated metal not only forms on the outer surface of the mesh but also forms through the mesh to provide improved rigidity in the final product. Moreover, because the starting material is a metal mesh, only relatively small amounts of metal plating material are necessary to provide the desired rigid final form of the product, and therefore the process of the invention is a cost efficient one. Further, because the starting material is a wire metal mesh, almost any desired shape (organic or geometric) including compounds angles can be obtained. In addition, in contrast to molding and casting techniques which have previously been used to prepare jewelry, the process of the present invention can provide such a wider variety of shapes in a much simpler manner. For example, the process of the present invention is very simple in comparison to the molding and/or casting technique, in that with the present process all that needs to be done is to cut the mesh into a size desired for the final shape and to fold, twist, scribe, etc. the mesh into the desired end shape. In most instances, the mesh itself holds its form and then all that needs to be done is to electroplate the metal onto the mesh to provide the desired metal product. There is no need to finish the edges and there is no complex clean up as in the molding or casting techniques.

Also, by the process and products of the present invention various textures can be provided to the ornamental product, e.g., a sculpture or a piece of jewelry. This can be provided by starting with various types of weaves of wire metal mesh, e.g., a plain weave, a twilled weave, a plain Dutch weave, twilled Dutch weave or herringbone weave. When electroplated, the weave effect can provide a relief or textured surface which gives the product the look of the weave employed. Thus, the products of the invention can have a "soft look" of a woven cloth rather than the "hard look" of smooth, nontextured metal surface. In addition, as will be explained further below, the process of the invention can provide a nodular type finish on at least portions of the end product by employing varying currents during the electroplating step of the process of the invention.

BRIEF DESCRIPTION OF THE DRAWINGS

For a more complete understanding of the present invention, reference is made to the following detailed description of exemplary embodiments considered in conjunction with the accompanying drawings, in which:

FIG. 1 is a perspective view of a bracelet constructed in accordance with the present invention;

FIG. 1(*a*) is a blown-up illustration of a portion of the outer surface of the bracelet showing the relief effect on such surface;

FIG. 2 is a top view of one embodiment of a stone setting in accordance with the present invention;

DETAILED DESCRIPTION OF THE INVENTION

Figure 3:
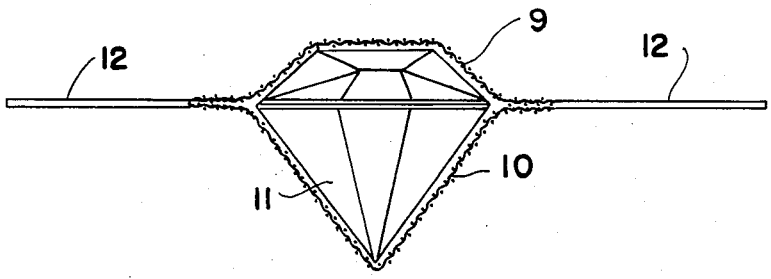
FIG. 3 is a cross-sectional view, taken along line 3—3 of FIG. 2 and looking in the direction of the arrows of the stone setting shown in FIG. 2.

The wire metal mesh (or cloth as it is sometimes referred to) employed in the present invention can be any electrically conductive wire metal mesh suitable for electroplating thereon the desired metal. Suitable metals for the wire mesh include stainless steel, brass, bronze, aluminum, copper, nickel, nickel alloys and the like. Stainless steel wire metal meshes are preferred in many instances because they can be formed into very fine meshes and still can retain good strength characteristics.

The wire metal mesh or cloth employed in the present invention can be of just about any desired mesh. Typically, the wire metal mesh employed in the present invention has a mesh (center to center) of 10×10 to 400×2800, preferably from 20×20 to 400×400. In one preferred embodiment of the present invention, in making, for example, a bracelet or necklace etc., 325×325 stainless steel mesh is employed.

The diameter of the wire employed in the wire metal mesh is again any diameter suitable for obtaining the desired effect. For example, if a high relief effect on a bracelet, earring, etc. is desired, larger diameter wires might be employed. Typically, wire diameters of from about 0.25 inches to about 0.001 inches can be employed in the present invention. In one preferred embodiment of the invention employing the 325×325 mesh, the wire diameter is about 0.0014 inches.

Typically, the percentage open area of the wire metal mesh employed in the present invention can vary between about 56 to about 30% or lower. In the preferred embodiment employing the 325×325 mesh, the percentage of open area is about 30%.

Wire metal meshes can be employed in various weaves. For example, wire metal meshes are available from Belleville Wire Cloth Co., Inc. in plain weave, twilled weave, plain dutch weave, twilled dutch weave, and herringbone weaves. In many embodiments of the invention, a twilled weave or other more structurally stiff weave is preferred so that the cloth better holds its shape when it is formed into the desired three dimensional shape, e.g., the shape of the piece of jewelry, etc.

The wire metal mesh can be easily formed into just about any desired shape by folding, twisting, scoring, scribing, etc. Typically. all that need be done is to cut the piece of wire metal mesh in the dimensions desired for the piece to be constructed. The cut wire metal mesh is then formed into the desired shape, e.g., of a bracelet, earrings, etc. by, for example, folding or bending. Almost any desired shape including even compound and acute angles can be obtained.

With reference to FIG. 1, which shows a bracelet prepared in accordance with the present invention, it can be seen that the wire mesh was folded to provide creases 1, 2, 3, 4, 5, and 6 and was shaped in a circular type fashion so as to form the shape of the bracelet. At the ends of the bracelet, the wire metal mesh was "pinched" together at points 7 and 8 to thus form the desired bracelet shape.

As mentioned above, the weave of the wire metal mesh is preferably such that the shaped wire metal mesh will maintain such shape without the need for further support. Wire metal mesh such as twilled weave available from Belleville Wire Cloth Co., Inc. is suitable in this connection. If the cloth employed is too flexible, it might be desirable to form the metal cloth into its desired shape and then solder it in such shape employing a low temperature melting lead solder.

The wire metal mesh can also be scribed or scored or folded. Such scribing, scoring or folding provides different reliefs and/or indentations in the wire metal cloth which remain and thus still appear in the final finished product after electroplating metal thereon. Such scribed or fold lines, in the wire metal mesh, when electroplated with metal, provide added strength to the electroplated final product and also can be placed on the mesh in such a manner so as to provide a supplemental decorative effect on the final product, e.g., the wire metal mesh can be scribed in a decorative fashion such as in the design of a feather or of veins of a leaf, which will appear in the relief of the final electroplated product.

The weave of the wire metal mesh can also provide a decorative relief to the electroplated product. In instances where the plated metal is not so thick as to obsure the pattern of the weave,, such weave pattern will appear as a relief surface or the final end product. This can be seen in the blown-up portion of the outer surface of the bracelet shown in FIG. 1(*a*), where the high points and low points of the weave appear in the relief of the electroplated product. In such relief, the areas of the electroplated metal surface between the wires of the weave are generally concave in configuration. Such relief can provide a "soft look" to the product in that the relief gives the product the look of cloth, rather than the "hard look" of normal smooth metal surfaces usually associated with jewelry.

Figure 4A:
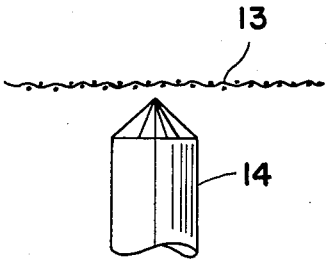
FIGS. 4(*a*)–4(*c*) are schematic illustrations showing the formation of a second embodiment of a stone setting in accordance with the present invention.
Figure 4B:
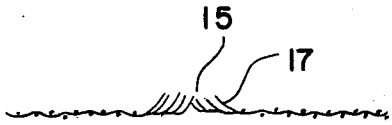
Figure 4C:
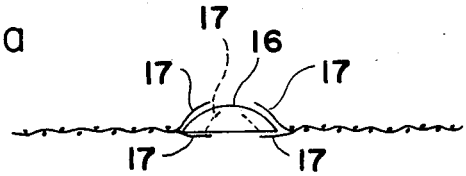

As shown in FIGS. 2, 3, and 4, the wire metal mesh can also be used to prepare stone settings.

In one embodiment, this can be accomplished by forming the wire metal mesh so as to hold a stone in a predetermined arrangement in a stone setting area of the wire metal mesh and then selectively electroplating the wire metal mesh so as not to electroplate any metal on the stone setting area. Preferably, the selective electroplating is performed by covering the stone setting area with a nonconductive masking material which prevents electroplating of the metal on the wire metal mesh in the stone setting area and wich is removed after the electroplating step.

In another embodiment of such a stone setting, the wire metal mesh is formed into a three-dimensional shape at least so as to provide an opening (e.g., by puncturing the mesh to form the opening and provide broken, loose strands) therein with loose strands of the wire about the opening. A stone is placed in the opening and the broken or loose strands of the wire area arranged about the stone so as to hold the stone in the opening and provide a setting for the stone. The wire metal mesh with the stone arranged therein is then electroplated with metal on the wire metal mesh and the broken or loose strands of wire to provide a fixed, rigid setting for the stone.

For example, in FIGS. 2 and 3 a stone setting in accordance with the first of the above embodiments is illustrated. In this case, a stone setting is provided by employing two sheets 9 and 10 of wire metal mesh. In such a setting, the stone 11, e.g., a diamond, is placed in a desired arrangement between the two sheets of wire metal mesh. One sheet could also be employed by rapping the sheet about the stone. The wire metal mesh sheets are joined together in any suitable manner around the stone to hold the stone in place. For example, the two sheets of wire metal mesh may themselves support the stone in the arrangement or the sheets can be soldered together. A nonconductive coating (e.g, a masking or stop-off material) is applied to the sheets of wire metal mesh in the area surrounding the stone so that, when electroplated, no metal will form on the wire metal mesh in the area coated by the nonconductive material. Any suitable nonconducting film forming material normally used as a mask in electroplating can be employed in this technique. For example, clear nail polish could be employed. The wire metal mesh sheets with the stone therebetween are then electroplated in a conventional manner as described below so that the metal electroplates on the wire metal sheets in the area 12 surrounding the masked (stone setting) area which includes the stone. After the electroplating step, the masking material is removed to provide the stone, e.g., a diamond or any other precious stone etc., in a fixed setting surrounded by the material electroplated to the wire metal meshes. As is illustrated in FIG. 2, the stone can be seen through the wire metal mesh because of the almost transparent nature of the mesh employed. Moreover, the wire metal mesh about the stone allows light transmission from almost all angles so that a stone like a diamond can receive light from a greater variety of angles and perhaps provide even better refraction characteristics than a diamond in a normal setting.

In another embodiment of the present invention as shown in FIGS. 4(*a*)–4(*c*) illustrates the latter of the stone settings. In the embodiment shown, a stone setting can be provided by puncturing the wire metal mesh 13 with a sharp object 14 to provide an opening 15 through the wire metal mesh of a suitable size for holding the stone 16 therein. The broken or loose strands 17 of the wire metal mesh can be used to hold the stone in place in the opening 15. Some of the broken of loose strands 17 can be placed above and below the stone to hold it in place. The wire metal mesh with the stone in place in the opening is then placed into the electroplating bath, where the wire metal mesh is electroplated as described further below. The electroplated metal on the wire metal mesh and on the loose strands provides a stiff and rigid setting for the stone in a unique and ornamental manner.

The electroplating step of the present invention can be performed in a manner conventional in the electroplating art. All that need be done is to attach an electrically conductive lead to the mesh, place the shaped mesh into a suitable electrolytic bath, and turn on the electrical current so that the mesh acts as the cathode and the desired metal is placed thereon. The electroplated metal fills the voids of the mesh and provides a continuous metal surface on the final product.

The lead can be attached, for example, by soldering it thereto, at a point where it is least noticeable, especially where the final product is to be a piece of jewelry or a sculpture, etc. In some instances, it is desirable to cover the lead with a nonconductive coating so as to prevent electroplating of metal on the lead during the plating process. Once the electroplating step has been completed, the lead can then be removed to provide the finished product. Also, the lead, for example, with an earring product in accordance with the present invention can employ a stirling silver or gold lead. In this latter case, the stirling silver or gold lead is covered with a nonconductive coating so as to prevent electroplating of metal thereon. After the electroforming process is completed, the nonconductive coating on this stirling silver or gold lead can be removed and the stirling silver or gold lead can be employed as an earring post or a French loop wire.

The electrolytic solutions and electroplating apparatus employed in the electroplating step of the present invention, as mentioned above, are conventional and therefore need not be described in detail here. However, some of the techniques employed in the present invention in such electroplating step will be described.

For example, in the initial stages of the electroplating step of the present invention, it is desirable to maintain the electrolytic solution still so as to create little or no agitation of the solution which might cause a change in shape of wire metal mesh. Once a coating of the electroplated metal has been formed on the wire metal mesh, agitation can be increased. This increased agitation helps in providing a smooth or glossy finished outer surface, if that is desired.

Also, as is conventional in the art, by employing various currents different types of finishes can be provided on the final product. Generally, in this regard, low currents will normally provide duller (matte or flat) finishes, while with higher currents and higher agitation a gloss finish can be obtained and with even higher currents a porous "treed" type effect can be obtained. This "treed" effect can be employed to impart a specific type of nodular appearance or decorative effect to the final finished article as further described below.

The electroplating step of the invention can be used to prepare, for example, costume jewelry or fine jewelry which will thus require different starting materials for the electrolytic bath. For example, costume jewelry can be prepared by first employing a conventional copper sulfate electrolytic bath to provide electroplated copper metal on the wire metal mesh to give the product its desired rigidity or stiffness, i.e., so that the electroplated product will maintain its desired shape during use. Then, a nickel coating can be electroplated on the copper as a barrier layer. Thereafter, a surface coating, if desired, of a precious metal, e.g., gold, silver or perhaps gun metal, can be electroplated thereon.

If fine jewelry is desired, one would just start with a conventional precious metal electrolytic bath and electroplate the precious metal directly onto the wire metal mesh. For the purist, the metal mesh could also be comprised of precious metal.

The electroplated metal on the wire metal mesh can be of any desired thickness so long as it at least fills in the voids of the mesh (i.e., provides a continuous metal surface) and provides the desired rigidity so that the product will maintain its shape during use, e.g., as jewelry or as a sculpture, etc. Also, because the wire metal meshes are of a certain type of weave, different relief appearances can be provided on the electroplated product by varying the metal thickness. Thus, with less metal electroplated on the mesh, more relief appearance from the underlying weave will be noticeable than with the thicker plated metal on the same type of mesh.

In one preferred embodiment of the present invention, for example, as illustrated in FIG. 1, the final article in the form of a piece of jewelry or a sculpture includes a nodulation effect on certain portions of the electroplated wire metal mesh. This nodulation effect can be obtained during the electroplating process by varying the currents employed in stages of the electroplating process. To provide this effect the wire metal mesh is initially electroplated with a high current and preferably little agitation. This provides a porous granular deposit on high current density areas of the wire metal mesh, i.e., along the edges or any creases or points of the wire metal mesh. The granular deposit provides a "treeing" effect as described above. Thus, in this initial portion of the electroplating step, larger portions of electroplated metal are plated on the high current density areas than on the flater or recessed portions of the shaped metal mesh. Subsequently, the current is reduced to provide a uniform electrodeposit on the surface of the shaped wire metal mesh. This electroplating had the lower current also glazes over the granular deposit to form the smooth glazed nodules 18 as shown in FIG. 1.

In another embodiment of the present invention, fine particles of material can be provided on the surface of the final product by providing fine particles of solid electrically conductive metal in the electrolytic bath (by imperfect electroplating or by addition of solid particles) so that they will be attracted to and attached to the wire metal mesh being electroplated. Thus, such fine particles give a further decorative surface texture to the finished final product. For example, when the electroplating step is formed with a copper sulfate electrolytic bath, if the electrolytic process is run in an imperfect manner, particles of the copper anode can break free and attach themselves to the wire metal mesh cathode being electroplated.

The electroplated products of the present invention can be used for any application in which a lightweight, rigid metal product is desired. However, for my purposes I prefer to employ the product as a piece of jewelry or sculpture, since it can provide a piece which has the look of a heavyweight piece but which in fact is lightweight but still of sufficient rigidity to be suitable for use as a piece of jewelry or as a sculpture.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A process for preparing a lightweight, rigid, metal product in a desired shape, said proces comprising the steps of providing an electrically conductive wire metal mesh having a plurality of woven wire strands defining voids therebetween; forming said electrically conductive wire metal mesh into a desired nonplanar three-dimensional shape; and electroplating a metal onto the surfaces of said wire strands of said wire metal mesh so as to completely fill the voids of said wire metal mesh to provide a metal rigid structure for the product in said desired nonplanar three-dimensional shape.

2. A process according to claim 1, wherein the forming step is performed by folding the wire metal mesh to provide creases in the wire metal mesh, which creases when electroplated with the metal provides added strength and rigidity to the electroplated nonplanar three-dimensional shape.

3. A process according to claim 1, wherein the wire metal mesh is scribed along at least one line to provide creases or indentations in the wire metal mesh along said at least one line, which at least one line when electroplated provides added strength and rigidity to the electroplated nonplanar three-dimensional shape.

4. A process according to claim 1, wherein said electroplating of said wire metal mesh in its nonplanar three-dimensional shape includes initially electroplating with a current sufficient to provide a porous granular deposit on portions of the mesh and subsequently electroplating with a second lower current sufficient to provide a uniform, smooth electrodeposit on the surface of the shape and to glaze over the porous granular deposit to form smooth, glazed nodules on said portions of the electroplated wire metal mesh.

5. A process according to claim 1, wherein said wire metal mesh is formed so as to hold an object in a predetermined arrangement in a setting area of said wire metal mesh, and wherein said wire metal mesh is selectively electroplated so as not to electroplate any metal on said setting area.

6. A process according to claim 5, wherein said selective electroplating is performed by covering said setting area of said wire metal mesh with a nonconductive masking material which prevents electroplating of said metal on said wire metal mesh in said setting area and which is removed after the electroplating step.

7. A process according to claim 1, wherein said wire metal mesh is formed into the nonplanar three-dimensional shape so as to provide an opening therein with loose strands of said wire metal mesh about said opening; wherein an object is placed in said opening and said loose strands are arranged about said object so as to hold said object in said opening and provide a setting for said object; and wherein said electroplating step is performed so as to electroplate said metal on said wire metal mesh and said loose strands thereof and provide a fixed, rigid setting for said object.

8. A process according to claim 1, wherein said wire metal mesh has a mesh size of from 20 by 20 to 400 by 400.

9. A process according to claim 1, wherein said wire metal mesh is formed into a nonplanar three-dimensional ornamental shape.

10. A process according to claim 9, wherein said wire metal mesh is formed into a nonplanar three-dimensional shape of a piece of jewelry selected from the group consisting of an earring, bracelet, ring, pendant, and necklace.

11. A process according to claim 1, wherein said wire metal mesh is comprised of a material selected from the group consisting of stainless steel, aluminum, brass, bronze, copper, nickel and nickel alloys.

12. A process according to claim 1, wherein said wire mesh is comprised of stainless steel.

13. A process according to claim 1, wherein said wire metal mesh has a mesh size of from $10\times10$ to $400\times2{,}800$.

14. A process according to claim 1, wherein said wire metal mesh has a mesh size of $20\times20$ or finer.

15. A lightweight, rigid, metal product comprising an electrically conductive wire metal mesh formed in a desired nonplanar three-dimensional shape, said wire metal mesh having a plurality of woven wire strands defining voids therebetween and having a metal electroplated on the surfaces of said wire strands so as to completely fill the voids of said formed wire metal mesh to provide a rigid structure for the product on said desired nonplanar three-dimensional shape.

16. A metal product according to claim 15, wherein the wire metal mesh is scribed or folded along at least one line so that, when the metal is electroplated on said wire metal mesh, the electroplated metal on said line provides added strength and rigidity to said metal product.

17. A metal product according to claim 15, wherein said metal product has smooth, glazed nodules on portions of said electroplated product created by initially electroplating with a first current sufficient to provide a porous granular deposit on portions of the mesh and subsequently electroplating with a second lower current sufficient to provide a uniform, smooth electrodeposit on the surface of the wire metal mesh and to glaze over the porous granular deposit to create said smooth, glazed nodules.

18. A metal product according to claim 15, wherein said metal product is in the form of a sculptural work of art.

19. A metal product according to claim 15, wherein said metal product is in the form of a piece of jewelry.

20. A metal product according to claim 1, wherein said metal product is in the form of a piece of jewelry selected from the group consisting of a bracelet, an earring, a ring, pendant, and a necklace.

21. A metal product according to claim 15, wherein said wire metal mesh is stainless steel.

22. A metal product according to claim 15, wherein said wire metal mesh has a mesh size of from 10×10 to 400×2,800.

23. A metal product according to claim 15, wherein said wire metal mesh has a mesh size of from 20×20 to 400×400.

24. A metal product according to claim 15, wherein said wire metal mesh has a mesh size of 20×20 or finer.

25. A setting for an object comprising an electrically conductive wire metal mesh having a plurality of woven wire strands defining voids therebetween, an object held in a preselected arrangement by said wire metal mesh in a setting area of said wire metal mesh, and metal electroplated onto said wire metal mesh at least in the area surrounding said setting area so as at least to fill the voids of said mesh without any metal being electroplated on said setting area.

26. A setting according to claim 25, wherein said object held in said preselected arrangement comprises a gem.

27. A setting for an object comprising an electrically conductive wire metal mesh having a plurality of woven wire strands defining voids therebetween and being formed into a shape so as to provide an opening therein with loose strands of said woven wire mesh about said opening; an object arranged in said opening with said loose strands arranged so as to hold said object in said opening; and a metal electroplated onto said wire metal mesh including said loose strands so as to at least fill said voids of the mesh to provide a fixed, rigid setting for said object in said opening.

28. A setting according to claim 27, wherein said object arranged in said opening comprises a gem.

* * * * *

UNITED STATES PATENT AND TRADEMARK OFFICE

CERTIFICATE OF CORRECTION

PATENT NO. : 4,543,803

DATED : October 1, 1985

INVENTOR(S) : Mark Keyasko

It is certified that error appears in the above-identified patent and that said Letters Patent is hereby corrected as shown below:

Column 1, line 24, "a" should read --as--.
Column 4, line 34, "wich" should read --which--.
Column 5, line 42, "placed" should read --plated--.
Column 5, line 58, "electroforming" should read --electroplating--.
Column 7, line 36, "proces" should read --process--.
Column 7, line 45, cancel the word "metal".
Column 7, line 60, after "its", insert --desired--.
Column 7, line 66, before "shape", insert --nonplanar--.
Column 9, line 8, "1" should read --19--.
Column 9, line 11, before "pendant", insert --a--.

Signed and Sealed this

*Eleventh* Day of *February 1986*

[SEAL]

*Attest:*

DONALD J. QUIGG

*Attesting Officer*

*Commissioner of Patents and Trademarks*